United States Patent [19]

Metzner

[11] 4,204,242

[45] May 20, 1980

[54] TIME DELAY CIRCUIT FOR TIMING RELAYS

[75] Inventor: Gerd L. Metzner, Berlin, Fed. Rep. of Germany

[73] Assignee: Schleicher GmbH & Co. Relais-Werke KG, Fed. Rep. of Germany

[21] Appl. No.: 913,663

[22] Filed: Jun. 8, 1978

[30] Foreign Application Priority Data

Jun. 13, 1977 [DE] Fed. Rep. of Germany ..... 2727073

[51] Int. Cl.[2] ..... H01H 7/14

[52] U.S. Cl. ..... 361/198; 307/252 F

[58] Field of Search ..... 361/198, 195, 196; 307/252 F

[56] References Cited

U.S. PATENT DOCUMENTS

| | | | |
|---|---|---|---|
| 3,689,807 | 9/1972 | Tenenbaum | 307/252 F |
| 3,814,948 | 6/1972 | Schuchmann et al. | 361/198 |
| 4,138,708 | 2/1979 | Takeshima | 361/198 |

FOREIGN PATENT DOCUMENTS

| | | | |
|---|---|---|---|
| 1902496 | 10/1970 | Fed. Rep. of Germany | 361/198 |
| 2160288 | 6/1973 | Fed. Rep. of Germany | 361/198 |
| 2361606 | 6/1974 | Fed. Rep. of Germany | 361/198 |
| 7531734 | 5/1977 | France | 307/293 |

OTHER PUBLICATIONS

GE Application Note, "The D13T-A Put" Spofford, W. R., Jr., Nov. 1967, vol. 90.70.

*Primary Examiner*—J. D. Miller
*Assistant Examiner*—L. C. Schroeder
*Attorney, Agent, or Firm*—Basile and Weintraub

[57] ABSTRACT

The invention is concerned with a time delay circuit for timing relays with operation by means of alternating potential with a rectifier, a programmable unijunction transistor and an RC network with a common junction point.

3 Claims, 1 Drawing Figure

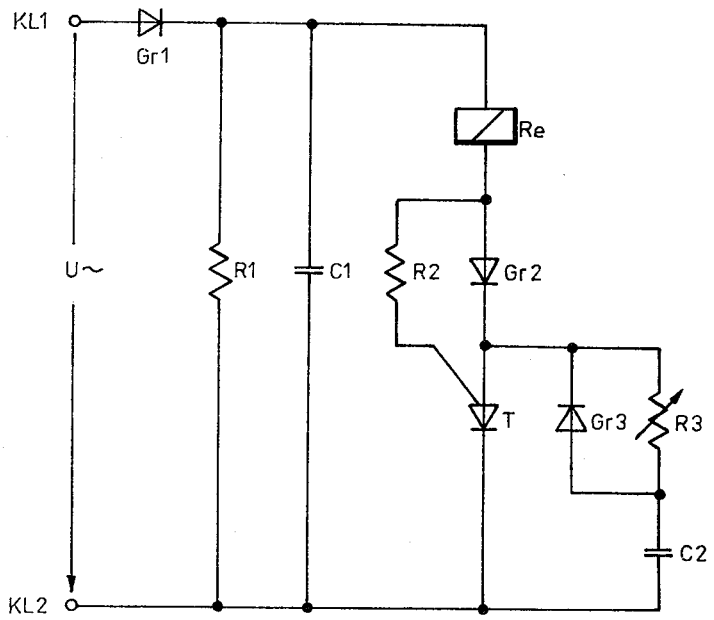
KL1
Gr1
Re
U~
R1
C1
R2
Gr2
T
Gr3
R3
C2
KL2

TIME DELAY CIRCUIT FOR TIMING RELAYS

BACKGROUND OF THE INVENTION

I. Field of the Invention

The present invention relates to time delay circuits.

II. Description of the Prior Art

Time delay circuits are actually known; for example, West German Patents No. DT-AS 1 902 496 and No. DT-AS 2 321 177. In case of the known timing relays with a time delay circuit of this type, the controlling alternating potential, that is, the supply potential or a similar potential, is rectified and applied to the timing cycle in the form of a substantially filtered direct potential with very small amplitude. The timing cycle is equipped with a programmable unijunction transistor which can be advantageously employed as a controllable semi-conductor element and an RC series circuit. An auxiliary potential is taken from the direct potential by means of a resistive voltage divider and applied to the gate of the programmable unijunction transistor as a reference potential. The potential of the auxiliary potential is the parameter which determines the time cycle. If after the application of the controlling supply alternating potential, the potential which is built up over a period of time, which potential is lower at the condenser of the RC series circuit, exceeds at the anode the potential of the auxiliary potential at the gate of the programmable unijunction transistor, this transistor is brought from its first closed condition into its second conductive condition and, thus, it applies a potential to a relay switch directly or via another switching unit such that this relay switch is turned on or turned off, respectively.

This known circuitry, in general, functions quite satisfactorily; however, for the most simple controlling functions for industrial installations with timing relay, it is too elaborate with regard to its economy and with regard to its technical aspects.

III. Prior Art Statement

The aforementioned prior art, in the opinion of the applicant, constitutes the most relevant prior art of which applicant is aware.

SUMMARY OF THE INVENTION

Beginning from this state of the art, the present invention is based on the objective to create a more simple circuit arrangement for timing relays of the type which were mentioned above and, that is, with the least elaborate equipment as far as the circuitry is concerned and for the field of application which occurs most frequently and for operation with alternating potential.

The solution of this problem is described in the characterizing portion of the main claim.

Advantageous modifications and extensions follow from the subclaims.

The circuit arrangement for timing relays, according to the invention, is a time delay circuit which is controlled by semiconductors where the timing function is started by the switching on of a control alternating potential. For the timing function, the potential which is built up over time and which is dependent on a condenser of an RC series circuit is utilized by a semiconductor unit, or by means of another switching unit the current is controlled by means of a switching relay coil.

It is significant with regard to the invention that the timing relay is supplied with an alternating voltage which is filtered only to a small extent and which, therefore, exhibits a relatively large amplitude and which alternating voltage is superimposed on the direct voltage.

Advantageous properties of the circuit arrangement result not only due to the very simple construction, but it is directly suitable for operation with alternating voltage supplies in an industrial control arrangement without, for instance, the use of separating transformers which have a filtering effect.

BRIEF DESCRIPTION OF THE DRAWING

The enclosed drawing shows an advantageous version of an example of a circuit arrangement for the case of a time delayed timing relay, which will be described in more detail below.

DESCRIPTION OF THE PREFERRED EMBODIMENT

A load resistor R1 and a filter condenser C1 are connected parallel with reference to each other via a rectifier diode Gr1 and via the connection points KL 1 and KL 2 to an alternating voltage supply U. Furthermore, in parallel arrangement with the filter condenser C1 and the load resistor R1, a series circuit of a relay coil Re, a diode Gr2 in current flow direction, and a programmable unijunction transistor T are connected with the rectified alternating potential where, in case of the series circuit, the anode of the transistor T is connected with the diode Gr2 and a programming resistor R2 from the connection between the relay coil Re and the anode of the diode Gr2 is connected with the gate of the programmable unijunction transistor T. An RC series circuit which consists of an adjustable resistor R3 and a timing condenser C2 is connected parallel to the anode and cathode of the programmable unijunction transistor T. In addition, the adjustable resistor R3 is bridged by a decoupling diode Gr3 with reversed polarity.

The circuit arrangement, which was described above, functions in the following way:

The supply voltage in the form of a alternating voltage is supplied as a controlling voltage between the connection points KL 1 and KL 2. From this controlling alternating voltage a direct voltage is generated by means of the rectifier diode Gr1, which rectifier diode Gr1 allows only the positive part of the alternating voltage to enter the circuit arrangement. An alternating or fluctuating potential with a certain amplitude is superimposed on this direct voltage by means of suitable dimensioning of the constructional elements; that is, mainly suitable dimensioning of the load resistor R1 and the filter condenser C1. This produces a direct potential which is limitedly filtered to therefore have a relatively high amplitude and, further, which direct potential includes a fluctuating or cyclically changing potential components. The alternating potential, superimposed direct potential is supplied to the gate of the closed programmable unijunction transistor T via the relay coil Re and the programming resistor R2, and in this way an alternating potential, superimposed reference potential is generated which defines the time cycle. At the same time the alternating voltage, superimposed direct voltage is always reduced by an amount which equals the current flow potential of the diode Gr2. This reduced voltage is applied to the anode of the closed programmable unijunction transistor T. This is created by the current which flows via the diode to the series circuit of the RC network R3, C2. Thus, this increases the safety of the closed condition because a firing current cannot flow from the anode to the gate, which firing current, in addition, is prevented because the necessary positive firing voltage still does not exist since the anode is negative with reference to the gate. The interference differential, which has thus been created for the closed condition of the programmable unijuncion transistor T, is still substantially improved due to the flow of current via the relay coil Re and the diode Gr2 to the series circuit or to the RC network R3, C2, respectively, since the relay coil Re is advantageously effective as inductivity in this circuit arrangement. The current flow to the RC network, which was mentioned above, is dimensioned in such a way that it cannot lead to an opening or closing of the relay contacts. Since the RC network R3,C2 is located parallel to the anode-cathode junction of the programmable unijunction transistor T, the anode is favorably separated from the minus potential of the circuit arrangement.

From the alternating potential, superimposed direct potential which is applied to the anode of the programmable unijunction transistor T, a direct potential is stored by integration via the load resistor R3 in the timing condenser C2. This storage takes place because the charging current can only flow in one direction into the timing condenser C2 via the diode Gr2. The stored direct potential, which increases over time due to integration in the timing condenser C2, is passed to the anode of the programmable unijunction transistor T via the decoupling diode Gr3. After the time delay has taken place due to the charging of the timing condenser C2, the time cycle determining reference potential is lower than the stored direct potential at the timing condenser C2 due to the superimposition of the reference potential with the alternating potential at the gate of the programmable unijunction transistor T, subtracted with the diode flow potential at the diode Gr3 and the firing potential of the programmable unijunction transistor T. In this way the necessary firing current for the programmable unijunction transistor T flows from the timing condenser C2 via the decoupling diode Gr3, anode gate, the programming resistor R2, the relay coil Re and the load resistor R1 to the minus potential of the circuit arrangement. The programmable unijunction transistor T fires and becomes conductive from the anode to the cathode in such a way that the timing condenser C2 is immediately discharged via the decoupling diode. Furthermore, the relay coil is energized by means of its energizing current via the diode Gr2, and the relay contacts are activated. The alternating current, superimposed direct current which now flows through the relay coil Re and the programmable unijunction transistor T is dimensioned in such a way that the relay contacts remain activated and that the current, which is programmed by the programming resistor R2 and which current ensures the conductive condition of the programmable unijunction transistor T, is not lowered. Only when the control alternating potential at the contact poins KL 1 and KL 2 is switched off, the circuit arrangement returns to its originalfunction and is ready for another start.

What is claimed is as follows:

1. In a time delay circuit for timing relays operated with alternating current, the circuit having first and second input terminals adapted to receive an alternating voltage, a rectifier for rectifying said alternating voltage to provide a direct voltage, a programmable unijunction transistor having anode, cathode and gate electrodes, a relay coil, the rectifier, relay coil and the anode and cathode electrodes of the programmable unijunction transistor connected in series across the first and second input terminals, and RC series network connected across the anode and cathode electrodes of the programmable unijunction transistor, wherein the direct voltage is applied to the anode electrode of the programmable unijunction transistor with limited filtering and used as a reference voltage, which is integrated by means of the RC series network and stored and compared with the reference voltage, the relay coil being energized as a result of the integrated output of the RC series network exceeding the reference voltage at the gate electrode of the programmable unijunction transistor, the improvement wherein the entire operating voltage is used as the reference voltage, and the direct voltage having limited filtering and therefore a relatively high amplitude is supplied to the relay coil; and a programming resistor connected between the relay coil and the gate electrode of the programmable unijunction transistor;

a diode connected in the forward direction between the relay coil and the anode electrode of the programmable unijunction transistor; and wherein, in each alternating voltage cycle, the reference voltage is applied across the relay coil and the programmable unijunction transistor reduced by the forward voltage of the diode.

2. The time delay circuit according to claim 1 further including a decoupling diode connected between the common junction of the RC network and the anode electrode of the programmable unijunction transistor such that the built-up potential at the timing condenser of the RC network is applied to the anode electrode of the programmable unijunction transistor; and wherein the reference voltage from the common junction between the relay coil and the diode is applied across the programming resistor to the gate electrode of the transistor.

3. The timing delay circuit according to claim 1, wherein an RC parallel network is connected between the rectifier and the second input terminal to limitedly filter the output of the rectifier.

* * * * *

UNITED STATES PATENT AND TRADEMARK OFFICE

CERTIFICATE OF CORRECTION

PATENT NO. : 4,204,242
DATED : May 20,1980
INVENTOR(S) : Gerd L. Metzner

It is certified that error appears in the above-identified patent and that said Letters Patent are hereby corrected as shown below:

Column 1, line 64, following the second occurrence of "unit" insert -- in which--;

Column 4, line 22, following "voltage" delete the comma and insert a semicolon;

Column 4, line 28, following "voltage" delete " , and " and insert a semicolon;

Column 4, line 31, following "coil;" delete "and".

Signed and Sealed this

Fourth Day of November 1980

[SEAL]

*Attest:*

SIDNEY A. DIAMOND

*Attesting Officer*

*Commissioner of Patents and Trademarks*